United States Patent [19]

Chesnut

[11] Patent Number: 4,566,212

[45] Date of Patent: Jan. 28, 1986

[54] CARTRIDGE CLIP

[76] Inventor: M. Gaines Chesnut, 17219 W. 57th Pl., Golden, Colo. 80401

[21] Appl. No.: 544,683

[22] Filed: Oct. 24, 1983

[51] Int. Cl.[4] ..... F41C 25/02

[52] U.S. Cl. ..... 42/50

[58] Field of Search ..... 42/50

[56] References Cited

U.S. PATENT DOCUMENTS 1,323,063 11/1919 Johnson et al. ..... 42/50
3,383,790 5/1968 Into ..... 42/50
3,736,686 6/1973 Moller et al. ..... 42/50
4,127,954 12/1978 Hausmann ..... 42/50

FOREIGN PATENT DOCUMENTS 149137 3/1952 Australia ..... 42/50

*Primary Examiner*—Charles T. Jordan
*Attorney, Agent, or Firm*—Sheridan, Ross & McIntosh

[57] ABSTRACT

A cartridge clip is provided with inner surfaces for guiding each cartridge for movement throughout the cartridge clip in the same arcuate path. Also, camming surfaces are provided adjacent the top edge of the cartridge clip so that the cartridge will move properly out of the cartridge clip and into a firearm.

8 Claims, 5 Drawing Figures

Fig. 1.
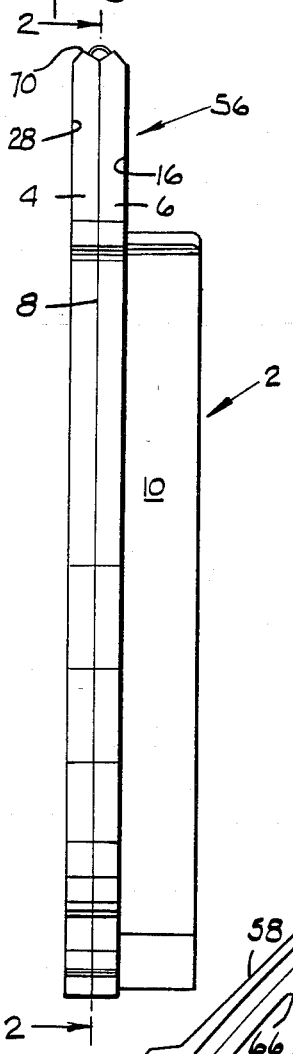
Fig. 2.
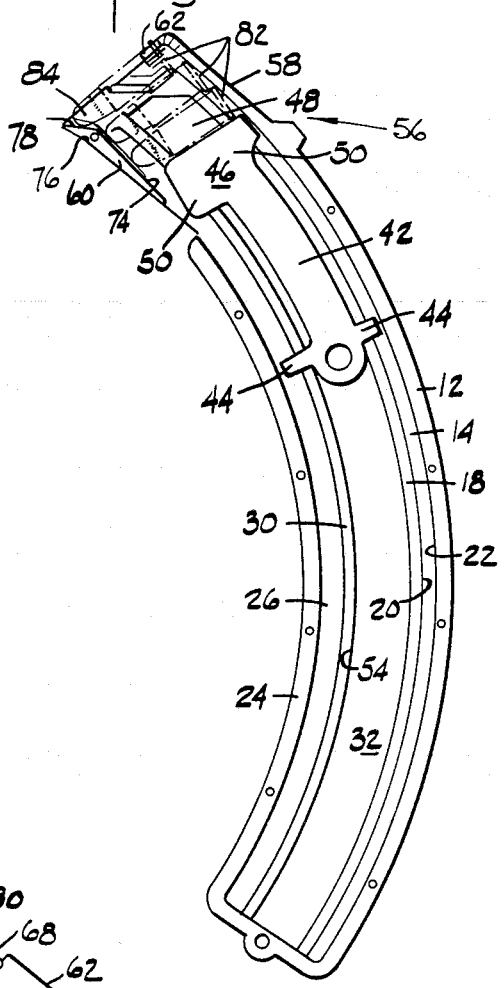
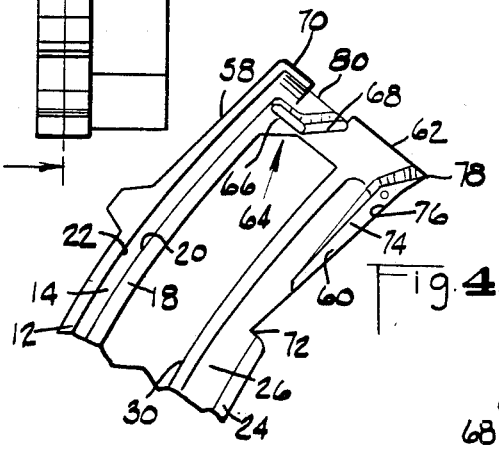
Fig. 4.
Fig. 3.
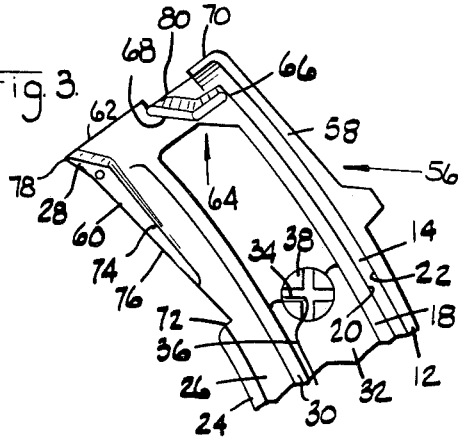
Fig. 5.
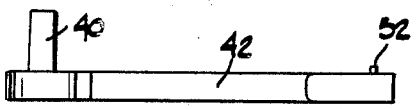

CARTRIDGE CLIP

FIELD OF INVENTION

This invention relates to a cartridge clip for holding cartridges for automatic feeding into a firearm and is particularly directed to a generally arcuate shaped cartridge clip which has linearly extending outer side walls adjacent one end for insertion into a firearm wherein the inner surfaces of the one end are provided with means for ensuring the proper movement of each cartridge out of the cartridge clip.

BACKGROUND OF THE INVENTION

For many years, arcuate-shaped cartridge clips have been used for holding cartridges for automatic feeding of cartridges into a firearm. Since the firearm must be designed to be used also with linear-shaped cartridge clips, the firearm is generally provided with a linearly-shaped recess for reception of the cartridge clip. For this reason, an arcuate-shaped clip is provided with a linearly shaped outer surface adjacent one end so that it may be readily inserted into the recess of the firearm. A typical arcuate-shaped cartridge clip is illustrated in U.S. Pat. No. 4,127,954 to Hausmann. Because of this modification of the outer surface, it is also necessary to modify the inner configuration of the cartridge clip. In the Hausmann patent, the inner surface of the insert 30 has two opposed linearly-extending inner surfaces adjacent the nose and rim of each cartridge. This necessity of modifying the inner configuration has resulted in many troubles such as the jamming of a cartridge in its translation of movement from an arcuate direction to a linear direction.

BRIEF SUMMARY OF THE INVENTION

This invention provides a cartridge clip wherein the rim of each cartridge is guided by means so that each cartridge has a continuous arcuate movement throughout the entire extent of the cartridge clip. Additionally, the cartridge clip is provided with means on the inner surfaces of the cartridge clip adjacent the opening in the cartridge clip through which each cartridge moves as it passes from the cartridge clip to the firearm which means guides the movement of the rim and the nose of each cartridge to ensure that its proper movement occurs. Although the preferred embodiment of this invention is directed to the generally arcuately shaped cartridge clip, some of the features ensure the proper movement of each cartridge in a generally linearly shaped cartridge clip.

In the preferred embodiment of the invention, a cartridge clip having an outer surface which is generally arcuately shaped is provided adjacent one end thereof with an outer surface that is generally linearly shaped so that it may be inserted into the recess of the firearm. The inner surfaces of the cartridge clip are provided with means providing two opposed grooves which are arcuately shaped and extend throughout the extent of the cartridge clip. Portions of the rim of each cartridge are located in the grooves so that each cartridge moves in an arcuate direction throughout the cartridge clip. The inner surfaces of the cartridge clip are provided with additional means providing opposed surfaces which are arcuately shaped and extend throughout the cartridge clip and function to provide guidance for the movement of the nose portion of each cartridge throughout the cartridge clip. At the linearly-shaped one end of the cartridge clip, the inner surface of one end wall of the cartridge extends in a linear direction at a predetermined angle to ensure proper movement of the nose portion of each cartridge. Also, the inner surfaces of the cartridge clip is provided with camming surfaces for both the rim portion and nose portion adjacent the opening in the cartridge clip to ensure proper movement of each cartridge out of the clip and into the firearm.

It is an object of this invention to provide a cartridge clip having a generally arcuately shaped outer configuration, except at the one end which is inserted into the firearm, with means on its inner surface for guiding the rim of each cartridge in an arcuate path throughout its movement in the cartridge clip.

It is another object of this invention to provide such a cartridge clip with an inner surface on one end wall adjacent to one end of the cartridge clip which inner surface extends in a linear direction at a predetermined angular relationship.

It is a further object of this invention to provide means on the inner surface of a cartridge clip to ensure proper movement of each cartridge out of the cartridge clip and into the firearm.

Other features and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

BRIEF DESCRIPTION OF THE DRAWINGS

FIG. 1 is a rear elevational view of the cartridge clip of this invention;

FIG. 2 is a side elevational view of one section of the cartridge clip of this invention taken on the line 2—2 of FIG. 1;

FIG. 3 is an enlarged view of the top of FIG. 2;

FIG. 4 is a view similar to that of FIG. 3 but illustrating the other section of the cartridge clip; and FIG. 5 is a side elevational view of the follower.

DETAILED DESCRIPTION OF THE INVENTION

The preferred embodiment of the invention is illustrated in the drawing and comprises a cartridge clip 2 having a first section 4 joined to a mating second section 6 along a seam line 8. The second section 6 has a projecting portion 10 for a purpose to be described. A notch is provided at the top juncture of the first and second sections 4 and 6 to expose a portion of a cartridge to be contacted by a member on the firearm (not shown) to move a cartridge out of the cartridge clip and into the firearm.

In FIGS. 2 and 3, the interior of the second section 6 is illustrated and in FIG. 4, the interior of the first section 4 is illustrated. In describing the cartridge clip, reference will be made only to FIGS. 2 and 3 with corresponding reference numerals applied to the mating parts in FIG. 4. Thus, one end wall of the cartridge clip comprises end wall 12 of the second section 6 mating with the end wall 12 of the first section 4. Extending inwardly from the end wall 12 is the inner surface 14 of a portion of the side wall 16. A projection 18 extends inwardly from the inner surface 14 for a distance less than the extent of the end wall 12 so as to form a groove between the facing surfaces 20 and 22 of the projection 18 and end wall 12. Since the same surfaces are formed in section 4, there are two opposed grooves.

The other end wall of the cartridge clip comprises end wall 24. Extending inwardly from the end wall 24 is the inner surface 26 of the side wall 28. A projection 30 extends inwardly from the inner surface 26 for a distance less than the extent of the end wall 24. A recess 32 is located between the projections 18 and 30 and is actually the inner surface of projecting portion 10. One end 34 of a coiled spring 36 is secured in the fixed spring retainer 38 in the recess 32 and the coiled portion (not shown) is placed around the projection 40 on the follower 42 which is positioned so that the coiled spring and the projection 40 are located in the recess 32. At one end, the follower 42 is provided with arms 44 which are guided for movement between the surfaces of the projections 18 and 30. At the other end, the follower is provided with a head 46 for contacting the lowermost cartridge 48 in the cartridge clip. The head 46 is provided with arms 50 which are guided for movement between the surfaces of the projections 18 and 30. A lug 52 extending outwardly from the surface of the follower 42 is positioned to contact the surface 54 of the pojection 30 to counteract any tendency for the coiled spring to cause binding of the follower during its movement in the cartridge clip.

One end 56 of the cartridge clip is provided with end walls 58 and 60 having outer surfaces which extend in a linear direction. This allows the end 56 to be inserted into a firearm. To achieve proper cooperation between the cartridge clip 2 and the firearm, it is desired that the top edge 62 of the cartridge clip 2 be substantially parallel to the bore of the firearm. In order to provide for this relationship, the end walls 58 and 60 extend from the top edge 62 at an angle of about 14°. As illustrated in FIGS. 3 and 4, the projection 18 terminates a short distance from the top edge 62. A camming surface 64 having a first section 66 that extends inwardly from the termination of the projection 18 and a second section 68 that extends upwardly at an angle to the top edge 62 is provided to guide the rim of a cartridge as it moves out of the cartridge clip and into the firearm. Projections 70 on the top edge 64 prevents a cartridge from moving directly out of the cartridge clip 2.

As illustrated in FIGS. 3 and 4, the end wall 24 terminates at its intersection 72 with end wall 60. The inner surface 74 of the end wall 60 extends in a linear direction at an angle of about 3° with the outer surface 76 of the end wall 60. This angular extent of the inner surface 74 provides a proper guide for the nose end of a cartridge. Adjacent to the top edge 62, the inner surface 74 projects outwardly to form a guide 78 for moving the nose of the cartridge up and out of the cartridge clip 2 and into the firearm. The top edge 62 has notches 80 so that the rim of a cartridge may be inserted into the cartridge clip 2.

A partially loaded cartridge clip is illustrated in FIG. 2. The rims 82 of each cartridge 48 have been inserted into the cartridge clip 2 through the notches 80. The rims 82 then move across the camming surface 64 and into the grooves between the surfaces 20 and 22. The outer surface of the cartridge is guided for movement in the cartridge clip 2 by the facing surfaces of the projections 18 and 30.

In operation, the follower 42 urges the cartridges 48 in the cartridge clip 2 toward the top edge 62. Movement of the cartridges 48 out of the cartridge clip 2 is prevented by the contact between the rim 82 and the projections 70. At the proper time, a portion of the firing mechanism of the firearm (not shown) contacts the rim 82 of the cartridge 48 and applies a force thereto. The rim 82 of the cartridge 48 moves over the sections 66 and 68 and the nose 84 of the cartridge moves over the guide 78 as the cartridge 48 is moved out of the cartridge clip 2. The movement of each cartridge 48 throughout the cartridge clip 2 is always along the same arcuate path between the surfaces 20 and 22 so that there is no possibility of a jam caused by a changing from an arcuate path to a straight path. Also, the angularity of the surface 74 keeps the nose 84 of each cartridge 48 in its proper path.

While the preferred embodiments of the invention have been illustrated and described herein, it may be otherwise embodied and practiced within the scope of the following claims.

What is claimed is:

1. A firearm cartridge clip for housing a number of cartridges, each of the cartridges having a rim, comprising:

a case for storing cartridges, said case including a top portion, first and second side walls, and first and second end walls joining said first and second side walls together to define a cavity, each of said first and second side walls having a width greater than the width of each of said first and second end walls, each of said first and second end walls having an outer surface and an inner surface;

first inner projections extending from each of said first and second side walls to provide surfaces spaced from and facing portions of said inner surface of said first end wall so as to form opposed grooves in said first and second side walls;

an opening formed adjacent to said top portion of said case through which the cartridges may be moved;

said inner surface of said first end wall extending in an arcuate direction substantially throughout the entire extent of said first end wall;

said second end wall including a discontinuity, said discontinuity being in the form of an aperture located substantially between first and second portions of said second end wall, said first portion extending in a first plane from said opening in said case top portion to said discontinuity, said discontinuity being parallel to said first plane and providing communication between said cavity and the exterior of the clip;

said inner surface of said second end wall second portion extending in an arcuate direction;

a portion of said outer surface of said first end wall extending away from said opening in a substantially linear direction;

a portion of said outer surface of said second end wall extending away from said opening in a substantially linear direction;

a follower mounted for sliding movement in said case and adapted to contact a lowermost cartridge in said case; and spring means for providing a force resisting movement of said follower into the case and for urging said follower in a direction out of said case as the cartridges are loaded into or moved out of said case.

2. A firearm cartridge clip for housing a number of cartridges, each of the cartridges having a rim, comprising:

a case for storing cartridges including a top portion, first and second side walls and first and second end walls joining said first and second side walls together, each of said first and second side walls having a width greater than the width of each of said first and second end walls, each of said first and second end walls having an inner surface and an outer surface;

first inner projections extending from each of said first and second side walls for use in forming opposed grooves in said first and second side walls;

an opening formed adjacent to said top portion of said case through which the cartridge may be moved;

portions of the rims of the cartridges in said case being located in said grooves for guiding the cartridges during movement thereof in said case;

said outer surface of a portion of said second end wall lying in a first plane;

said inner surface of said second end wall having a first portion lying in a second plane, said first portion having an upper end adjacent to said opening formed in said top portion of said case;

said inner surface of said second end wall having a second portion extending in an arcuate direction;

a lip member for guiding a cartridge into the firearm, said lip member having an inner surface and an outer surface, said inner surface extending from said upper end of said first portion at an angle outwardly of said second plane, said outer surface of said lip member extending at an angle outwardly of said first plane;

a follower mounted for sliding movement in said case and adapted to contact the lowermost cartridge in said case; and spring means operatively connected to said follower for providing a force resisting movement of said follower into the case and for urging said follower in a direction out of said case as the cartridges are loaded into or moved out of said case.

3. A cartridge clip as in claim 2 and further comprising:

means on said inner surface of said second end wall defining a surface for guiding the nose of each cartridge as it is moved out of said case.

4. A cartridge clip as in claim 1 or 2 and further comprising:

second inner projections extending from the termination of each of said first inner projections to provide surfaces facing said opening; and said surfaces facing said opening providing camming surfaces against which the rim of each cartridge rides as it is moved out of said case.

5. A cartridge clip as in claim 4 wherein:

each of said second inner projections having two sections;

one of said sections extending in a direction generally parallel to said opening; and the other of said sections extending at an angle between said one section and said opening.

6. A cartridge clip as in claim 4 and further comprising:

third inner projections from each of said side walls adjacent to but spaced from said arcuate inner surface of said second end wall second portion; and said third inner projections being parallel to said arcuate inner surface and having opposed surfaces for guiding the nose of each cartridge during movement through said case.

7. A cartridge clip as in claim 1 or 2 and further comprising:

an arcuate recess formed in the inner surface of one of said side walls;

a first projection extending from one surface of said follower and positioned in said recess for guiding said follower during movement thereof; and a second projection extending from one surface of said follower and spaced from said first projection, said second projection positioned for guiding said follower during movement thereof.

8. A cartridge clip as in claim 1 or 2, further comprising:

means defining a recess in one of said side walls;

guide means depending from said follower; and means for locating said guide means and said spring means in said recess.

* * * * *